United States Patent [19]

Gschwender et al.

[11] Patent Number: 4,854,834

[45] Date of Patent: Aug. 8, 1989

[54] PUMP WITH IMPROVED SEAL

[75] Inventors: Alois Gschwender, Neubulach; Andreas Szeteli, Obere Gärten; Horst Krüger, Nelkenweg, all of Fed. Rep. of Germany

[73] Assignee: Flux-Geräte GmbH, Stuttgart, Fed. Rep. of Germany

[21] Appl. No.: 71,396

[22] Filed: Jul. 9, 1987

[30] Foreign Application Priority Data

Jul. 9, 1986 [DE] Fed. Rep. of Germany ..... 3622963

[51] Int. Cl.[4] ..... F04B 47/02

[52] U.S. Cl. ..... 417/423.3; 417/423.11; 417/423.12; 417/424.1; 415/111; 415/168.4

[58] Field of Search ..... 417/423 M, 424 R, DIG. 1, 417/423 B, 423 K, 423 P, 423 S; 416/241 B; 415/111, 112, 170 A

[56] References Cited

U.S. PATENT DOCUMENTS

| | | | |
|---|---|---|---|
| 1,902,431 | 3/1933 | Wais | 415/112 |
| 1,928,795 | 10/1933 | Reid | 417/423 M |
| 2,149,602 | 3/1939 | Horvarth | 417/424 R |
| 2,868,233 | 1/1959 | Clark | 417/423 M |
| 3,408,942 | 11/1968 | Davenport et al. | 417/423 M |
| 3,716,309 | 2/1973 | Mitchell | 415/170 A X |
| 4,073,606 | 2/1978 | Eller | 415/170 A X |
| 4,362,471 | 12/1982 | Langes et al. | 416/241 B |
| 4,530,641 | 7/1985 | Gschwender | 417/170 R |
| 4,614,453 | 9/1986 | Tsune et al. | 416/241 B |
| 4,621,981 | 11/1986 | Lorett | 417/423 M |
| 4,669,953 | 6/1987 | Gschwender | 415/122 X |
| 4,671,740 | 6/1987 | Ormistan et al. | 416/241 B |
| 4,679,994 | 7/1987 | Brown | 417/DIG. 1 |

FOREIGN PATENT DOCUMENTS

| | | | |
|---|---|---|---|
| 0173579 | 3/1986 | European Pat. Off. | 415/170 A |
| 3328484 | 2/1985 | Fed. Rep. of Germany | 415/111 |

*Primary Examiner*—Carlton R. Croyle
*Assistant Examiner*—Eugene L. Szczecina, Jr.
*Attorney, Agent, or Firm*—Kenyon & Kenyon

[57] ABSTRACT

A pump has a rotor-carrying pump shaft rotatably supported within an internal pipe by a plurality of spaced bearings. A lowermost bearing is located in the vicinity of the rotor near the end of the internal pipe. Adjacent to the lowermost bearing is a seal provided in a reduced-pressure chamber within the internal pipe, the chamber being closed off at the lower end by the bearing juxtaposed to the rotor. The reduced-pressure chamber is connected to an outlet opening in an external pipe which surrounds the internal pipe and is spaced therefrom to provide a transport channel for effluent material being moved by the rotating rotor.

20 Claims, 5 Drawing Sheets

PUMP WITH IMPROVED SEAL

BACKGROUND OF THE INVENTION

This invention relates to a pump, especially to a submersible pump.

In submersible pumps, the rotor is connected to the motor by a drive shaft surrounded by a first, internal, pipe in turn surrounded by a second, external, pipe. A seal is provided below a lowermost bearing, immediately adjacent to the rotor. The lowermost bearing is disposed in the internal pipe at a considerable distance from the rotor. Owing to this relatively large distance between the lowermost bearing and the rotor, the section of the drive shaft in that region at the end of the internal pipe is subjected to relatively large shocks. The seal, which generally takes the form of a slip ring seal, is also subjected to considerable stresses and can fail at an early time.

An object of the present invention is to provide an improved pump particularly of the submersible type.

Another, more particular, object of the present invention is to provide such a pump wherein a seal located in a region about a lowermost bearing is subjected to a minimum of wear and tear during pump operation.

SUMMARY OF THE INVENTION

A pump in accordance with the present invention comprises a rotor connected to a motor by a drive shaft surrounded by a first pipe which extends from the motor towards the rotor. A plurality of bearings is provided for supporting the shaft in the first pipe, one of the bearings being disposed in a region about the rotor proximately to an end of the first pipe. A seal for the first pipe has a radial position between the shaft and the first pipe and an axial position between the bearing near the rotor and another bearing adjacent to that first bearing. A second pipe surrounds the first pipe and is radially spaced therefrom to form a transport channel for effluent moved by rotation of the rotor. The second pipe is provided with an outlet communicating with the transport channel and is further provided with an opening. A reduced-pressure chamber is provided in the first pipe in a region about the rotor proximately to an end of the first pipe, the seal being disposed in the reduced-pressure chamber. The chamber is connected to the opening in the second pipe, whereby the chamber can be subjected to reduced pressure to evacuate leakage material from the chamber through the opening in the second, external, pipe.

In a pump in accordance with the present invention, the lowermost bearing is located below the seal (i.e., between the seal and the rotor) and is therefore but a small distance from the rotor. The lowest section of the pump shaft is optimally supported and guided, inasmuch as the distance between the lowest shaft section and the rotor is small. The lowest shaft section accordingly runs very quietly and experiences little or no shock disturbances. The shock load placed on the seal is likewise considerably reduced, whereby the seal can have a long operating life. Should the material being pumped enter the reduced-pressure chamber, the leakage cannot rise further in the first, internal, pipe but is led to the opening in the external pipe. Because the seal is located in the reduced-pressure chamber, the seal need not be pressure proof.

The principle of the invention applies to submersible pumps, drum pumps and centrifugal pumps.

DETAILED DESCRIPTION

Figure 1:
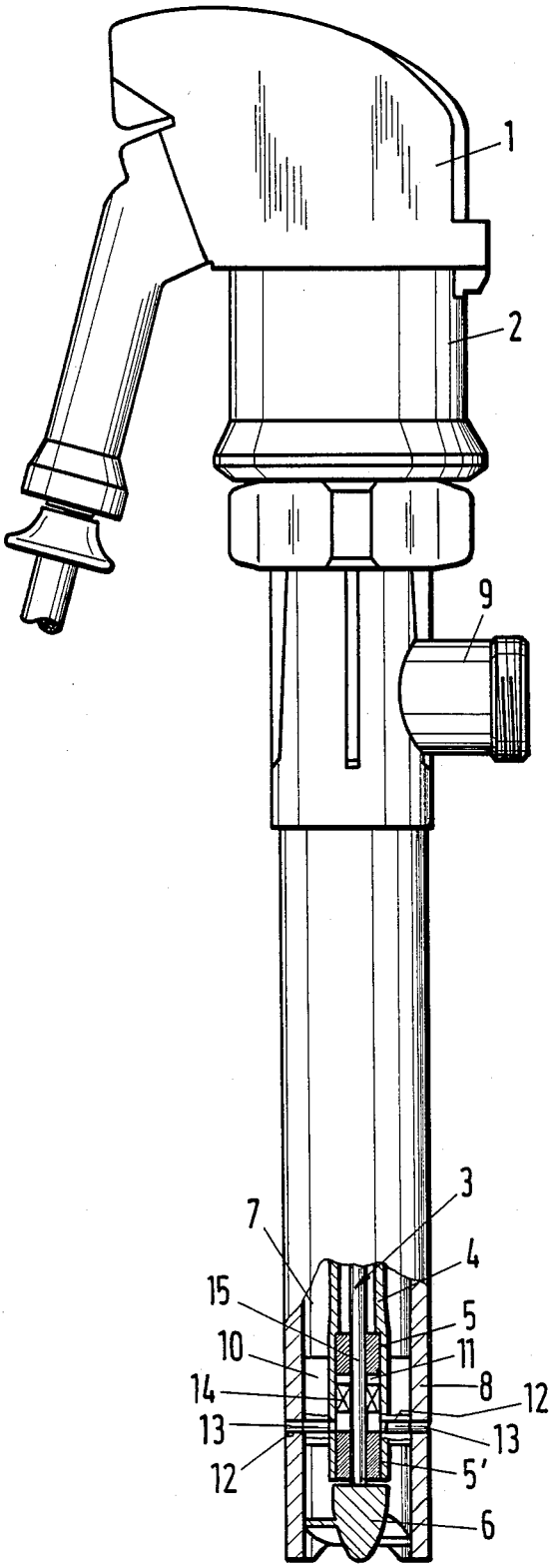
FIG. 1 is a side elevational view, partially in cross-section, of a first embodiment of a pump in accordance with the present invention.

As illustrated in FIG. 1, a submersible pump, particularly a drum pump, has a motor 1 with a motor shaft (not illustrated) connected via a coupling 2 to a pump shaft 3. Pump shaft 3 is surrounded by a first, internal, pipe 4 which extends from motor 1 towards a rotor 6 fixed to the free end of pump shaft 3. Pump shaft 3 is rotatably supported in internal pipe 4 by a plurality of bearings 5 distributed over the length of the pump shaft.

Internal pipe 4 surrounded by a second, external, pipe 8 which is spaced in a radial direction from the internal pipe to form a transport or uptake channel 7 for guiding effluent material moved by the rotation of rotor 6. The effluent material exits uptake channel 7 via an outlet 9 formed in external pipe 8. Internal pipe 4 is supported in the external pipe by centering pieces 10 distributed over the length thereof. Centering pieces 10 are formed so that effluent material can be delivered to outlet 9 without difficulty.

A bearing 5', preferably a friction bearing, is provided immediately adjacent to rotor 6 at the lower end of pipe 4. An adjacent bearing 5, likewise preferably a friction bearing, is disposed in pipe 4 at a slight distance from lowermost bearing 5'. To prevent effluent material which might possibly leak past bearing 5', exemplarily between bearing 5' and pipe 4, from moving upwardly inside pipe 4 a reduced-pressure chamber 11 is provided on a side of bearing 5' opposite rotor 6. Should effluent material leak into chamber 11, the leakage is prevented from rising in pipe 4 by reduced pressure in chamber 11. Chamber 11 advantageously communicates with a vacuum source 35 via conduits or ducts 12 extending from internal pipe 4 to outlet openings 13 in external pipe 8. All effluent material entering reduced-pressure chamber 11 flows to the outside under the evacuation force exerted by vacuum source 35.

As an additional safety feature, a seal 14 is located in reduced-pressure chamber 11 at a radial position between shaft 3 and internal pipe 4 and at an axial position between lowermost bearing 5' and the bearing 5 adjacent thereto. More specifically, seal 14 is axially disposed between conduits or ducts 12 and the second bearing 5.

A shaft section 15 between lowermost bearing 5' and the adjacent bearing 5 is subjected to only very small shocks during rotation of pump shaft 3 because shaft section 15 is optimally guided by the two bearings. Because the two bearings are placed closely adjacent to rotor 6, shock in the region of shaft section 15 is reduced to a minimum. Accordingly, seal 14 is stressed only slightly and can optimally fulfill its sealing function.

Lower shaft section 15 rotates smoothly and quietly for the additional reason that bearing 5' is disposed immediately adjacent to rotor 6. The lever arm between bearing 5' and rotor 6 is therefore small, reducing noisy vibration.

Inasmuch as seal 14 is located in reduced-pressure chamber 11, the seal need not be pressure roof. The reduction of pressure in chamber 11 prevents leakage material from rising inside pipe 4, the leakage material being guided through ducts 12 to openings 13.

Because bearing 5' comes into contact with the effluent material being pumped, that bearing preferably consists of corrosion resistant material. Bearing 5' is exemplarily fabricated from coal or hard carbides such as silicon carbide. Alternatively, ceramic materials such as aluminum oxide can be used for bearing 5'. A particularly resistant material advantageously used for the lowermost bearing is a polytetrafluoroethylene-compound material.

In the event that lowermost bearing 5' need not be corrosion resistant, the bearing can consist exemplarily of bronze.

Inasmuch as no effluent material can pass beyond the second bearing 5, owing to reduced-pressure chamber 11 and seal 14, the portion of pump shaft 3 located above the second bearing 5 can be of a material of lower quality than the material of shaft section 15. Shaft section 15 must comprise a resistant and high-quality material, because that portion of pump shaft 3 can come into contact with leakage of the material being pumped. Shaft section 15 must be constructed in a special way depending on the type of seal 14. If seal 14 exemplarily takes the form of a lip seal, shaft section 15 must have a hard surface to minimize wear and tear of the lip seal. Shaft section 15 can in such a case be hardened or, alternatively, be provided with an oxide or a metallic coating, the coating being applied using any of the many known methods for applying such coatings, which ensures a good sliding fit or engagement of the lip seal. The surface of shaft section 15 should be formed, in the case that a lip seal is used, with a low degree of roughness to facilitate smooth sliding of the lip seal as well as to provide a minimum of wear and tear. Shaft section 15 need be provided with a hard surface only if the pump is intended to operate continuously. If, on the contrary, the pump is to be operated only intermittently, shaft section 15 need not be provided with a hard surface.

Figure 2:
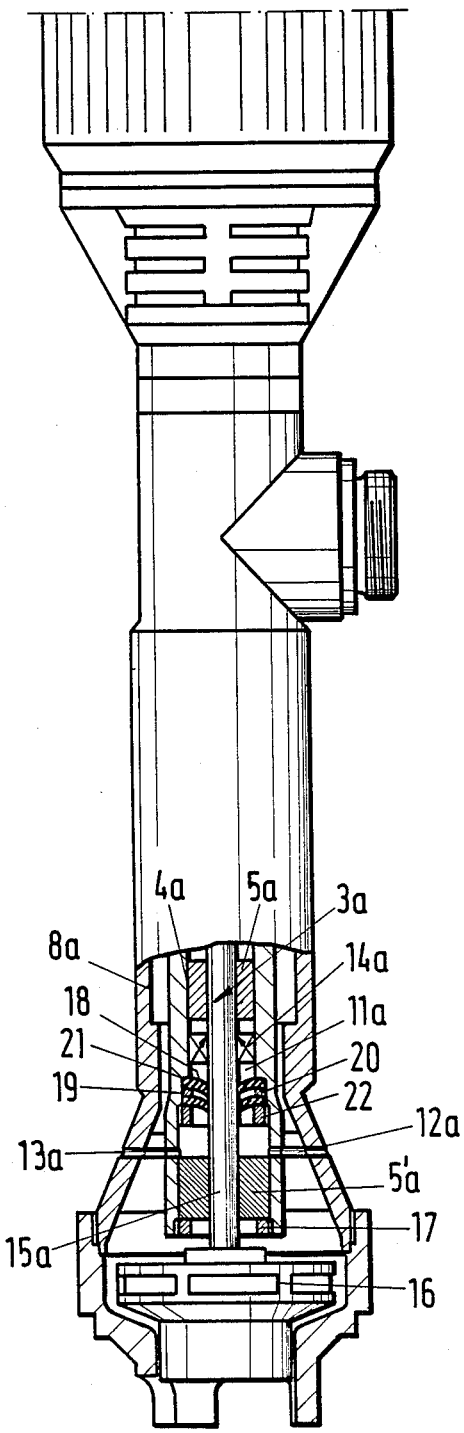
FIG. 2 is a side elevational view, partially in cross-section, of a second embodiment of a pump in accordance with the present invention.

As illustrated in FIG. 2, a centrifugal pump has a pump shaft 3a attached at a lower or free end to a rotor 16 in the form of a pump cover. A lowermost bearing 5a' in an internal pipe 4a surrounding pump shaft 3a is axially secured by a guard ring 17. Two lip seals 18 and 19 are provided in a pressure reduction chamber 11a which communicates via outlet conduits or ducts 12a with outlet openings 13a in an external pipe 8a surrounding internal pipe 4a. Seals 14a, 18 and 19 are disposed above outlet ducts 12a, i.e., have axial positions between ducts 12a and a second bearing 5a. Lip seal 18 is clamped by a spacer ring against a setoff or shoulder 21 in internal pipe 4a. Lip seal 19 in turn is clamped against spacer ring 20 by a clamp ring 22 screwed into internal pipe 4a. Both lip seals 18 and 19 engage pump shaft 3a, thereby sealing it. Additional seal 14a is disposed in the area between lip seal 18 and bearing 5a. A shaft section 15a between lowermost bearing 5a' and the second lowermost bearing 5a experiences only small shocks inasmuch as the shaft section is rotatably supported by bearings 5a and 5a' in pipe 4a at a small distance from pump cover 16. Seals 14a, 18 and 19 can consist of an elastomere material, preferably polytetrafluoroethylene, which has a high resistance to chemically reactive materials as well as to mechanical wear and tear.

Figure 3:
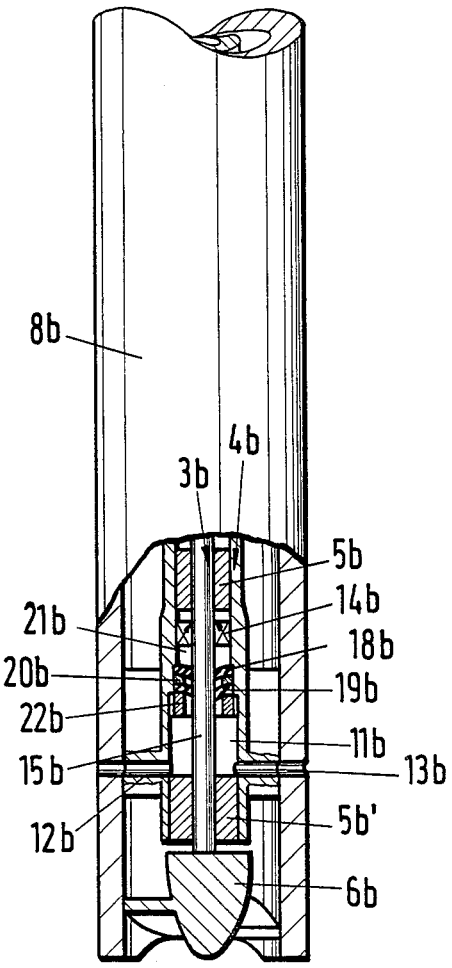
FIG. 3 is partially a side elevational view and partially a longitudinal cross-sectional view of a lower portion of a third embodiment of a pump in accordance with the present invention.

As depicted in FIG. 3, a pump in accordance with the present invention may include an internal pipe 4b provided at a lower end with a lowermost bearing 5b'. Between lowermost bearing 5b' and an adjacent bearing 5b, two lip seals 18b and 19b, as well as an additional seal 14b, are provided. Upper lip seal 18b is clamped between a shoulder 21b on the inside of pipe 4b and a spacer ring 20b. Spacer ring 20b separates upper lip seal 18b from lower lip seal 19b. Lower lip seal 19b is clamped against spacer ring 20b by a clamp ring 22b screwed into pipe 4b. The pump has a rotor 6b attached to the lower end of a pump shaft 3b. Seals 14b, 18b and 19b are located in a pressure reduction chamber connected via outlet ducts 12b to outlet openings 13b in an external pipe 8b surrounding internal pipe 4b. The pump of FIG. 3 corresponds for the remaining part to the embodiment of FIG. 2. A shaft section 15b between lowermost bearings 5b and 5b' is subjected to only small shocks, whereby seals 14b, 18b and 19b are minimally stressed and subjected to little wear and tear.

Figure 4:
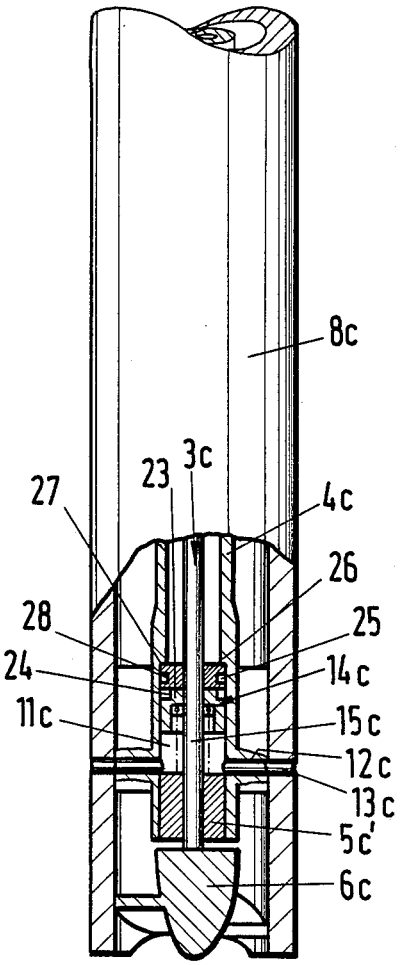
FIG. 4 is partially a side elevational view and partially a longitudinal cross-sectional view of a lower end of a fourth embodiment of a pump in accordance with the present invention.

A rotor 6c of the pump embodiment of FIG. 4 is fastened to the lower end of a pump shaft 3c. A lowermost shaft section 15c is rotatably supported by only one bearing 15c' fastened at the free end of an internal pipe 4c in a force or friction lock fit. A pressure reduction chamber 11c is connected via ducts 12c to outlet openings 13c in an external pipe 8c surrounding internal pipe 4c. A seal 11c disposed in pressure reduction chamber 11c includes a slip ring 23 which lies against a sealing surface 25 of another sealing ring 26. Slipring 23 is pressed against sealing ring 26 by the force exerted by a pressure spring 24. Sealing ring 26 fits tightly in internal pipe 4c and rests axially against a shoulder 27 of internal pipe 4c. Sealing ring 26 is provided on an outside surface with an O-ring seal 28 which seals ring 26 against internal pipe 4c. Pressure spring 24 rests against a lowermost bearing 5c' and against slipring 23, while slippering 23 is connected in a torsion-proof manner to pump shaft 3c. The remaining components of the pump of FIG. 4 are essentially identical to corresponding components of the pump embodiment of FIG. 3. Owing to the support through bearing 5c', shaft section 15c is subjected to only slight shocks and the sensitive slip ring seal 14c is stressed minimally so that a long operating life of the seal is ensured while effecting optimal sealing.

Figure 5:
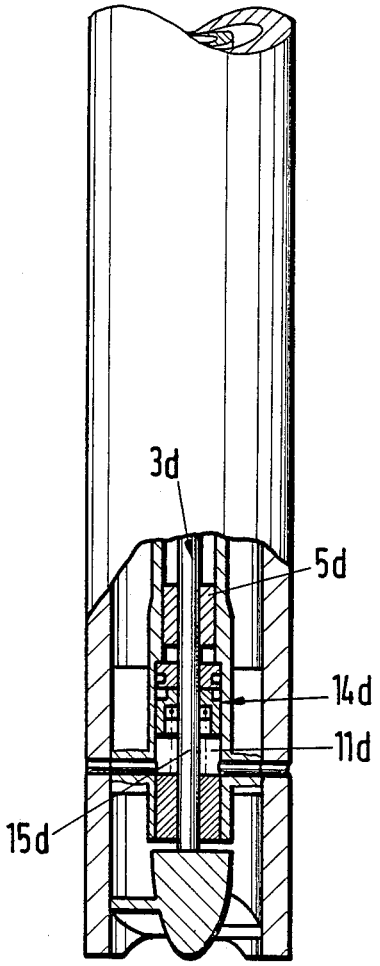
FIG. 5 is partially a side elevational view and partially a longitudinal cross-sectional view of a lower end of a fifth embodiment of a pump in accordance with the present invention.

The embodiment of FIG. 5 differs from the embodiment of FIG. 4 only in that a bearing 5d is provided above a slipring seal 14d. In this way, shaft section 15d of pump shaft 3d is supported more effectively to reduce shocks to a minimum.

What is claimed is:

1. A pump comprising;

a rotor;

motor means for driving said rotor;

a drive shaft connected at one end to said motor means and at an opposite end to said rotor;

a first pipe surrounding said shaft and extending from said motor means towards said rotor;

support means for supporting said shaft in said first pipe, said support means including a plurality of bearings located between the rotor and motor, one of said bearings being disposed in a region about said rotor proximately to an end of said first pipe;

sealing means for sealing said first pipe, said sealing means including at least one seal having a radial position between said shaft and said first pipe and an axial position between said one of said bearings and another of said bearings adjacent thereto;

a second pipe surrounding said first pipe, said second pipe being radially spaced from said first pipe to form a transport channel for effluent moved by rotation of said rotor, said second pipe being provided with an outlet communicating with said channel, said second pipe being further provided with an opening;

a reduced-pressure chamber in said first pipe in a region about said rotor proximately to an end of said first pipe, said seal being disposed in said chamber; and means for connecting said opening with said chamber, whereby said chamber is subjectable to a reduced pressure to evacuate leakage material from said chamber through said opening.

2. The pump defined in claim 1 wherein said sealing means includes a slip ring seal.

3. The pump defined in claim 1 wherein said sealing means includes a lip seal.

4. The pump defined in claim 1 wherein said chamber is closed at one end by said one of said bearings and at an opposite end by said other of said bearings.

5. The pump defined in claim 1 wherein said means for connecting includes a duct extending through said channel from said first pipe to said second pipe.

6. The pump defined in claim 1 wherein said shaft is provided in a region about said seal with a hardened surface.

7. The pump defined in claim 1 wherein said shaft is provided in a region about said seal with a hard surface coating.

8. The pump defined in claim 7 wherein said coating comprises a ceramic oxide coating.

9. The pump defined in claim 7 wherein said coating comprises a metallic coating.

10. The pump defined in claim 1 wherein said sealing means includes a lip seal and an additional seal spaced from one another.

11. A submersible pump comprising:

a rotor;

motor means for driving said rotor;

a drive shaft connected at one end to said motor means and at an opposite end to said rotor;

a first pipe surrounding said shaft and extending from said motor means towards said rotor;

support means for supporting said shaft in said first pipe, said support means including a plurality of bearings located between the rotor and motor, one of said bearings being disposed in a region about said rotor proximately to an end of said first pipe;

sealing means for sealing said first pipe, said sealing means including at least one seal having a radial position between said shaft and said first pipe and an axial position between said one of said bearings and another of said bearings adjacent thereto;

a second pipe surrounding said first pipe, said second pipe being radially spaced from said first pipe to form a transport channel for effluent moved by rotation of said rotor, said second pipe being provided with an outlet communicating with said channel, said second pipe being further provided with an opening; and conduit means connecting said opening with a space in said first pipe between said one of said bearings and said seal, whereby said space is subjectable to a reduced pressure to evacuate leakage material from said space through said opening.

12. The pump defined in claim 11 wherein said sealing means includes a slip ring seal.

13. The pump defined in claim 11 wherein said sealing means includes a lip seal.

14. The pump defined in claim 11 wherein said space constitutes a portion of a low-pressure chamber closed at one end by said one of said bearings and at an opposite end by said other of said bearings.

15. The pump defined in claim 11 wherein said conduit means includes a duct extending through said channel from said first pipe to said second pipe.

16. The pump defined in claim 11 wherein said shaft is provided in a region about said seal with a hardened surface.

17. The pump defined in claim 11 wherein said shaft is provided in a region about said seal with a hard surface coating.

18. The pump defined in claim 17 wherein said coating comprises a ceramic oxide coating.

19. The pump defined in claim 17 wherein said coating comprises a metallic coating.

20. The pump defined in claim 11 wherein said sealing means includes a lip seal and an additional seal spaced from one another.

* * * * *